US005553884A

United States Patent [19]

Abondance

[11] Patent Number: 5,553,884

[45] Date of Patent: Sep. 10, 1996

[54] SKI COMPRISING NARROW SIDES AND AN UPPER SHELL

[75] Inventor: Roger Abondance, La Murette, France

[73] Assignee: Skis Rossignol S.A., Voiron, France

[21] Appl. No.: 576,168

[22] Filed: Dec. 19, 1995

Related U.S. Application Data

[63] Continuation of Ser. No. 221,935, Apr. 1, 1994, abandoned.

[30] Foreign Application Priority Data

Apr. 16, 1993 [FR] France ..... 93 04728

[51] Int. Cl.[6] ..... A63C 5/04; A63C 5/14

[52] U.S. Cl. ..... 280/609; 280/610; 280/602

[58] Field of Search ..... 280/607, 609, 280/610, 602

[56] References Cited

U.S. PATENT DOCUMENTS

| | | | |
|---|---|---|---|
| 3,272,522 | 9/1966 | Kennedy, III . | |
| 3,926,451 | 12/1975 | Guild | 280/609 X |
| 4,902,548 | 2/1990 | Cholat-Serpoud et al. | 280/610 X |
| 4,953,885 | 9/1990 | Comert et al. | 280/610 |
| 4,971,349 | 11/1990 | Diard et al. | 280/609 |
| 4,993,740 | 2/1991 | Recher et al. | 280/610 |
| 5,088,755 | 2/1992 | Jodelet | 280/609 |
| 5,217,243 | 6/1993 | Recher et al. | 280/610 |
| 5,238,260 | 8/1993 | Scherubl | 280/610 |
| 5,280,943 | 1/1994 | Commier et al. | 280/609 |
| 5,292,148 | 3/1994 | Abondance et al. | 280/610 X |
| 5,366,234 | 11/1994 | Rohrmoser | 280/607 X |

FOREIGN PATENT DOCUMENTS

| | | |
|---|---|---|
| 0490044 | 6/1992 | European Pat. Off. . |
| 2522976 | 9/1983 | France . |
| 2611518 | 9/1988 | France . |
| 2683734 | 6/1993 | France . |
| 4130110 | 4/1992 | Germany . |

*Primary Examiner*—Brian L. Johnson
*Attorney, Agent, or Firm*—Oliff & Berridge

[57] ABSTRACT

A ski includes longitudinal reinforcement elements that are supported on edges of the ski and that form the lateral sides of the ski. The reinforcement elements also serve to support and fix the sides of a shell of the ski. In one zone of the ski, the height of the reinforcement elements may be substantially equal to the height of the ski, while in at least one other zone of the ski, the height of the reinforcement elements is smaller than the height of the ski. The shell includes a central portion and peripheral wings. In at least one zone of the ski, the central portion of the shell is spaced above the peripheral wings, the central portion being connected to the peripheral wings by a lateral side portion.

16 Claims, 2 Drawing Sheets

SKI COMPRISING NARROW SIDES AND AN UPPER SHELL

This is a Continuation of Application Ser. No. 08/221,935, filed Apr. 1,1994 now abandoned.

The present invention relates to a ski, and in particular an alpine ski comprising lateral sides and an upper shell.

BACKGROUND OF THE INVENTION

A traditional ski comprises a lower surface constituted by a sole edged with longitudinal edges, on which rigid lateral sides rest. The lateral sides are made, for example, of ABS or of phenolic laminate. These lateral sides, which extend over the entire height of the ski, are generally perpendicular to the sole of the ski. Arranged between the lateral sides is the core which can be made in various ways. If appropriate, the core may be made with reinforcement elements, the core itself being covered by an upper wall which likewise rests on the upper wall of the lateral sides.

The advantage of such a ski is that the rigidity of the lateral sides ensures excellent transmission of the forces exerted by the skier on the surface of the snow.

It is more and more frequent, for aesthetic reasons and for reasons of industrialization of the manufacture of the skis, to make shaped skis. The shaped skis may be of non-rectangular cross-section, having a shell which forms the upper face and the lateral sides of the ski. These lateral sides being, if appropriate, inclined over at least a part of their height. In such a case, the core can be made of synthetic foam material, for example polyurethane, which has excellent properties of stability over time as well as being of low weight.

DESCRIPTION OF THE PRIOR ART

However, this latter type of ski, illustrated in particular by documents FR 2 611 518, U.S. Pat. No. 3,272,522 and FR 2 522 976, does not always provide complete satisfaction because the transmission of the forces onto the edges from the upper face of the ski is not carried out in a sufficiently firm manner, taking into account the absence of lateral sides and the inclination of the lateral walls. This transmission takes place only via reinforcement sheets of the shell, which are applied flat against the inclined flanks and which are supported at points on the edges. These skis therefore have behavior characteristics which cannot completely satisfy the required criteria, in particular in competition, where the desired guiding accuracy for the skis necessitates a transmission which is as perfect as possible of the forces from the upper face of the ski towards the edges.

Generally, the shells constituting modern skis comprise an upper protection element supporting the decoration of the ski, covering a reinforcement made of glass fabric and containing, if appropriate, carbon or aramid fibers constituting the upper reinforcement of the ski. This reinforcement fabric could, in the upper part corresponding to the upper face of the ski, be constituted only by unidirectional fibers. However, it is imperative that the flaps, which constitute the lateral sides of the ski, comprise fibers oriented in the direction of the weft, which are necessary for obtaining sufficient strength, particularly in torsion, and bringing about a support on the edges. It is therefore necessary to use fabrics comprising a warp and a weft, even if this structure is overdimensioned for making the upper surface of the ski which mainly has to ensure simple flexion strength of the ski.

SUMMARY OF THE INVENTION

The aim of the invention is to provide a ski, in which the transmission of forces from the upper face of the ski towards the edges is effected in the best possible conditions, and which comprises a shell forming its upper face and at least a part of its lateral sides so as to have good aesthetic qualities.

To this end, the ski comprise, a filling core, for example made of polyurethane foam, and a lower face equipped with a central sliding sole and delimited by two longitudinal metal edges. The ski also includes reinforcement and decoration sheets, and longitudinal reinforcement elements, each of which is supported on an edge and forms the lateral sides of the ski. The longitudinal reinforcement elements support and fix the sides of the shell, the height of the reinforcement elements being essentially equal in at least one zone of the ski to the height of the ski while, in at least one other zone of the ski, the height of the reinforcement elements is smaller than the height of the ski. In addition, the shell has at least one part which is inclined from the top to the bottom and from the inside towards the outside.

This ski has longitudinal reinforcement elements forming lateral sides which are supported on the edges and ensure a good transmission from the upper face of the ski towards the edges. Moreover, the fact that the upper wall of the ski is constituted by a shell imparts to the ski interesting aesthetic qualities, makes possible an industrialization of its manufacture and makes it possible to have, in given zones of the ski, lateral walls which are in part inclined. The shell design makes it possible to adapt the characteristics of the ski to the type of use envisaged.

According to a first embodiment, in the central zone, the height of at least one reinforcement element is smaller than the height of the ski, the shell having at least one corresponding inclined part. In at least one of the end zones, the height of at least one reinforcement element is essentially equal to the height of the ski.

In these end zones, ski tip and heel, the cross-section of the ski corresponds to that of a traditional ski. In the central zone, this ski comprises, over a part of its height, and at least of one of its sides, an inclined part belonging to the shell.

According to another embodiment, in the runner zone, the height of at least one reinforcement element is essentially equal to the height of the ski. In at least one of the end zones, the height of at least one reinforcement element is smaller than the height of the ski, the shell having at least one corresponding inclined part.

In its central zone, this ski has a cross-section corresponding to that of a traditional ski. In its end zones, ski tip and heel, the ski comprises at least on one of its sides an inclined surface resulting from the presence of the shell. This latter type of ski makes possible good holding on hard snow, because of the good transmission of the forces exerted on the surface of the snow towards the upper surface of the ski, in the central zone. In addition, the ski exhibits good behavior in powdery snow, because of the tapering of the end zones, ski tip and heel.

Advantageously, the upper reinforcement fabric of the shell is constituted by unidirectional fibers oriented only in the longitudinal direction of the ski, which constitutes an economy factor without detracting from the qualities of the ski.

The two reinforcement elements can be symmetrical in relation to a longitudinal median plane of the ski or unsymmetrical in relation to this plane. In addition, each ski of a pair of skis may be unsymmetrical with respect to a longitudinal median plane of the ski, but the pair can have a symmetry in relation to the longitudinal median plane passing between the two skis. In this instance, the two inside reinforcement elements of the pair of skis may have a height which is essentially equal to the height of the skis, over at least a part of the length of the skis, while the outer reinforcement elements of the pair of skis may have a height which varies, over the length of the ski, in relation to the overall height of the skis. This makes it possible to favor the holding of the ski by having a reinforcement element which is effective over at least a part of its length in the region of the inner support side, while refining the external side, by virtue of the presence of at least one inclined part of the shell, to facilitate maneuvers in powdery snow.

According to one embodiment of this ski, each inclined part of the shell ends, towards the bottom, in a return which is parallel to the plane of the sole and which is supported on the upper face of a reinforcement element which forms a lateral side.

In any case, the invention will be clearly understood with the aid of the description which follows, with reference to the attached schematic drawings which represents by way of non-limiting example two embodiments of this ski.

DESCRIPTION OF THE PREFERRED EMBODIMENTS

Figure 1:
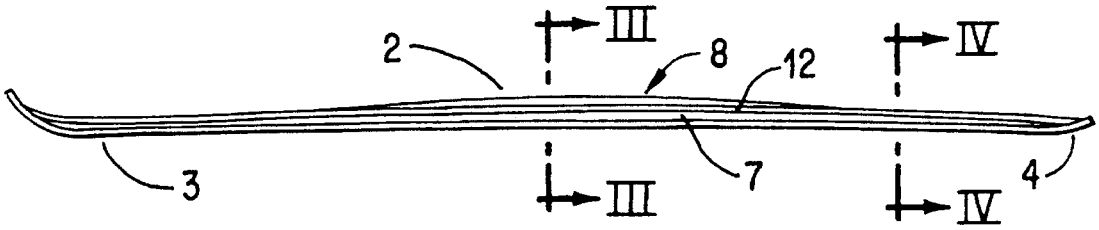
FIGS. 1 and 2 are two views, from the side and from above respectively, of a first ski.
Figure 2:
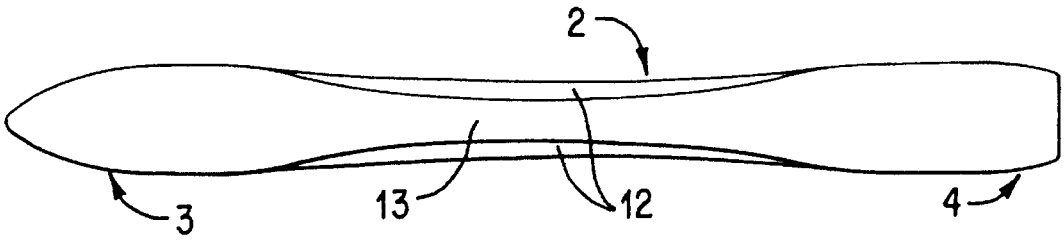
Figure 3:
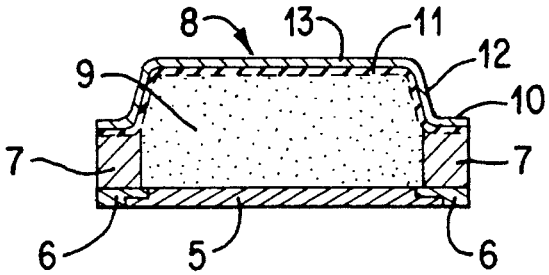
FIGS. 3 and 4 are two views thereof in trans-verse cross-section respectively along the lines III—III and IV—IV in FIG. 1.
Figure 4:
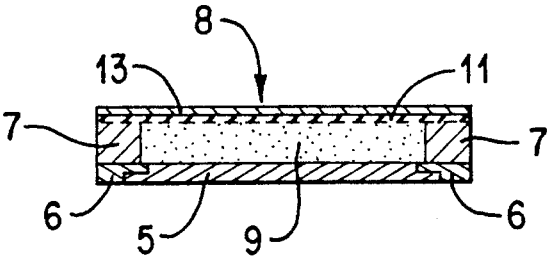
Figure 5:
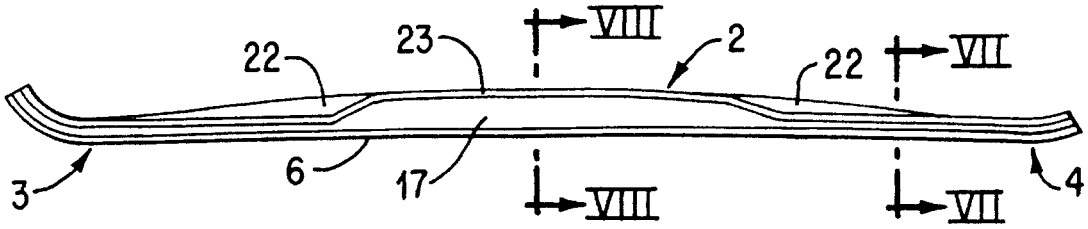
FIGS. 5 and 6 are two views, from the side and from above respectively, of a second ski.
Figure 6:
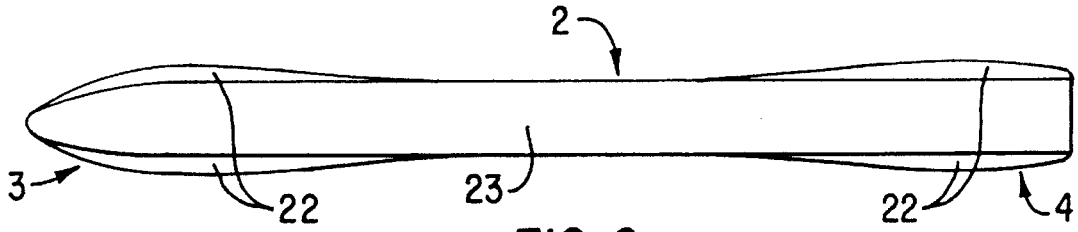
Figure 7:
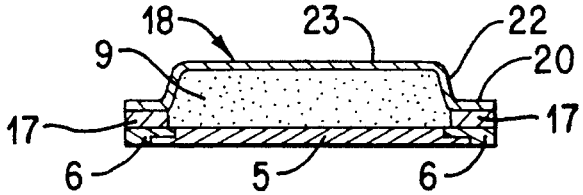
FIGS. 7 and 8 are two views thereof in transverse cross-section respectively along the lines VII—VII and VIII—VIII in FIG. 5.

The ski represented in FIGS. 1 to 4 comprises, in known manner., a central zone 2, a ski tip zone 3 and a heel zone 4. This ski comprises a lower face equipped with a sliding sole 5 delimited by two metal edges 6, on which are supported two longitudinal reinforcements 7 forming the lateral sides of the ski. The upper part of the ski is constituted by a shell 8, for example made of thermoformed synthetic material, against the internal face of which a reinforcement strip 11 is applied flat, the heart of the ski being formed by a filling core 9, for example made of polyurethane foam.

In the embodiment represented in FIGS. 1 to 4, each longitudinal reinforcement has, in the central zone, a height which is noticeably smaller than the height of the ski. The reinforcement serves as support for the shell 8, which includes returns 10 which are essentially parallel to the sole 5. Each of the returns 10 are supported on a corresponding reinforcement 7. The shell includes and inclined part 12 which is inclined from the top to the bottom and from the inside towards the outside. The inclined part 12 is connected to the upper face 13, which is parallel to the sole 5.

In the end zones 3 and 4, the height of each longitudinal reinforcement 7 is essentially equal to the height of the ski, so that the shell 8 is supported directly, via its plane upper face 13, on the upper faces of the longitudinal reinforcements 7.

This structure makes it possible to have a ski which has a rectangular cross-section in its end zones and which has lateral walls which are, in part, inclined in its central zone.

In such a structure, the height of the longitudinal reinforcement 7 can be constant over the entire length of the ski.

FIGS. 5 to 8 represent another embodiment of a ski.

Figure 8:
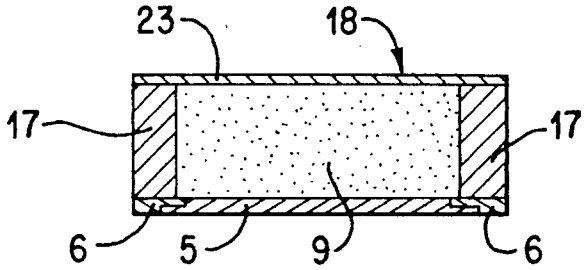

In this ski, the height of each reinforcement element 17 which forms a lateral side is essentially equal to the height of the ski in the central zone of the ski, as shown in particular in FIG. 8. In contrast, in the end zones of the ski, the height of each reinforcement element 17 is noticeably smaller than the height of the ski. In these conditions, the shell 18 comprises, in its end zones, two returns 20 which are essentially parallel to the sole 5 and are supported on the upper faces of the two reinforcement elements 17. The two returns 20 are connected to the upper face 23 of the shell by two inclined parts 22, which are inclined from the top to the bottom and from the inside towards the outside. In the central part of the ski, or central zone, the upper face 23 of the shell is supported directly on the upper faces of the two reinforcement elements 17.

The two skis, which have just been described above, make it possible to combine the advantages of skis with lateral sides as far as performance is concerned and the advantages of skis with a shell as far as industrialization and finishing quality are concerned.

Figure 9:
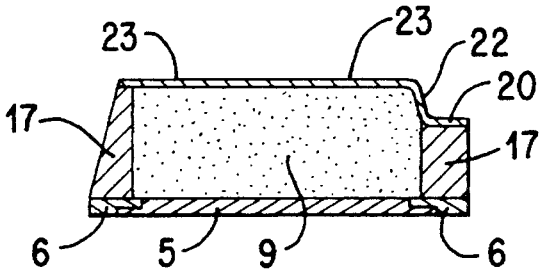
FIG. 9 is a transverse cross-section of a ski embodying the present invention.

It goes without saying that the skis described above could be subject to modifications, it being possible for the inclined parts of the shell to be situated only on one of the two sides of the ski, or in an end zone of the latter, and for the external surfaces of the reinforcement elements to be inclined in relation to the perpendicular to the plane of the sole at an angle which is constant or variable over the length of the ski, without departing in any way from the spirit or scope of the invention, as shown in FIG. 9.

I claim:

1. A ski, comprising:

a lower face including a central sliding sole delimited by two edges, the edges being located on opposite sides of the sliding sole;

at least two reinforcement elements extending in a longitudinal direction of the ski over at least first and second longitudinally displaced zones of the ski, each reinforcement element being supported on one of the edges;

a core located on the lower face and between inner lateral sides of the reinforcement elements; and a shell having a cross-sectional width and a central portion and two lateral portions, the central portion and the two lateral portions extending in the longitudinal direction of the ski, the two lateral portions of the shell being supported by the reinforcement elements, wherein in the first zone of the ski the shell is flat across the cross-sectional width and extends substantially parallel to the lower face, and wherein in the second zone of the ski the central portion of the shell is spaced above at least one of said lateral portions, the central portion being connected to the at least one lateral portion by at least one lateral side portion, said second zone of the ski having a non-rectangular cross-section.

2. The ski as claimed in claim 1, wherein the second zone of the ski corresponds to a longitudinally middle portion of the ski, and wherein the first zone of the ski corresponds to at least one of longitudinally front and rear portions of the ski.

3. The ski as claimed in claim 1, wherein the second zone corresponds to at least one of longitudinally front and rear portions of the ski, and wherein the first zone corresponds to a longitudinally middle portion of the ski.

4. The ski as claimed in claim 1, wherein the at least two reinforcement elements are symmetrical with respect to each other about a longitudinal axis of the ski.

5. The ski as claimed in claim 1, wherein the at least two reinforcement elements are asymmetrical with respect to each other about a longitudinal axis of the ski.

6. The ski as claimed in claim 1, wherein the shell is asymmetrical about a longitudinal axis of the ski.

7. The ski as claimed in claim 6, wherein at least one of said lateral portions extends throughout the first and second zones coplanarly with the central portion.

8. The ski as claimed in claim 1, wherein the at least one lateral portion of the shell at the lateral side portion forms a return that is substantially flat in cross-section and substantially parallel to the lower face.

9. The ski as claimed in claim 1, wherein outer lateral sides of the reinforcement elements are inclined at an angle with respect to the perpendicular to the plane of the sliding sole.

10. The ski claimed in claim 9, wherein the angle is constant over a length of the ski.

11. The ski as claimed in claim 9, wherein the angle is variable over a length of the ski.

12. The ski as claimed in claim 1, further comprising a reinforcement sheet attached to an internal surface of the shell.

13. The ski as claimed in claim 12, wherein the reinforcement sheet comprises a plurality of unidirectional fibers that extend in the longitudinal direction of the ski.

14. The ski as claimed in claim 1, wherein the two edges are metal.

15. The ski as claimed in claim 1, wherein the at least two reinforcement elements comprise two reinforcement elements.

16. A ski, comprising:

a lower face including a central sliding sole delimited by two edges, the edges being located on opposite sides of the sliding sole;

at least two reinforcement elements extending in a longitudinal direction of the ski over at least first and second longitudinally displaced zones of the ski, each reinforcement element being supported on one of the edges;

a core located on the lower face and between inner lateral sides of the reinforcement elements; and a shell having a central portion and two lateral portions, the central portion and the two lateral portions extending in the longitudinal direction of the ski, the two lateral portions of the shell being supported by the reinforcement elements, wherein in the first zone of the ski the shell is substantially flat and extends substantially parallel to the lower face, and wherein in the second zone of the ski the central portion of the shell is spaced above at least one of said lateral portions, the central portion being connected to the at least one lateral portion by at least one lateral side portion, said shell at said second zone of the ski having a non-rectangular cross-section that is different in cross-section than said shell at said first zone.

* * * * *